US007994740B2

(12) United States Patent
Bermuth et al.

(10) Patent No.: US 7,994,740 B2
(45) Date of Patent: Aug. 9, 2011

(54) BETATRON WITH A REMOVABLE ACCELERATOR BLOCK

(75) Inventors: Joerg Bermuth, Mainz (DE); Georg Geus, Wiesbaden (DE); Gregor Hess, Wiesbaden (DE); Urs Viehboeck, Darmstadt (DE)

(73) Assignee: Smiths Heimann GmbH, Wiesbaden (DE)

( * ) Notice: Subject to any disclaimer, the term of this patent is extended or adjusted under 35 U.S.C. 154(b) by 280 days.

(21) Appl. No.: 12/431,699

(22) Filed: Apr. 28, 2009

(65) Prior Publication Data

US 2009/0267543 A1 Oct. 29, 2009

Related U.S. Application Data

(63) Continuation of application No. PCT/EP2007/007768, filed on Sep. 6, 2007.

(30) Foreign Application Priority Data

Oct. 28, 2006 (DE) ..... 10 2006 050 950

(51) Int. Cl.
*H05H 11/00* (2006.01)

(52) U.S. Cl. ..... 315/504; 378/57

(58) Field of Classification Search ..... 315/500, 315/501, 504; 378/57, 121, 143
See application file for complete search history.

(56) References Cited

U.S. PATENT DOCUMENTS 2,480,169 A * 8/1949 Westendorp ..... 315/500
2,510,448 A * 6/1950 Wideroe ..... 315/15
2,533,859 A * 12/1950 Wideroe ..... 315/504
2,538,718 A * 1/1951 Wideroe ..... 315/504
2,546,484 A * 3/1951 Wideroe ..... 315/507
2,572,414 A * 10/1951 Wideroe ..... 315/504
2,572,551 A * 10/1951 Wideroe ..... 315/15
2,631,234 A * 3/1953 Wideroe ..... 315/504
2,675,470 A * 4/1954 Wideroe ..... 315/504
2,695,978 A 11/1954 Scag
2,738,421 A * 3/1956 Westendorp ..... 315/500
2,822,490 A 2/1958 Scag
3,009,083 A 11/1961 Sipek
3,614,638 A * 10/1971 Ananiev et al. ..... 315/504
3,921,019 A 11/1975 Karasawa
3,975,689 A * 8/1976 Geizer et al. ..... 315/504
4,392,111 A * 7/1983 Rostoker ..... 315/504
5,065,418 A 11/1991 Bermbach et al.
6,201,851 B1 * 3/2001 Piestrup et al. ..... 378/121

(Continued)

FOREIGN PATENT DOCUMENTS

DE 23 57 126 A1 5/1975

(Continued)

*Primary Examiner* — Thuy Vinh Tran
(74) *Attorney, Agent, or Firm* — Muncy, Geissler, Olds & Lowe, PLLC

(57) ABSTRACT

A betatron is provided, particularly in an x-ray inspection station, comprising an accelerator block that is provided with a rotationally symmetrical inner yoke composed of two spaced-apart pieces, at least one main field coil, and a toroidal betatron tube which is disposed between the pieces of the inner yoke. The betatron further comprises an outer yoke which embraces the accelerator block, connects the two pieces of the inner yoke, and has at least one lateral opening, as well as a lead shield that accommodates the accelerator block and the outer yoke. The outer yoke is composed of at least two parts which are movable relative to one another between an open and a closed position. The accelerator block can be laterally removed from the opening of the outer yoke that is in the open position.

12 Claims, 3 Drawing Sheets

U.S. PATENT DOCUMENTS

2005/0218347 A1 10/2005 Williamson et al.

FOREIGN PATENT DOCUMENTS

EP 0 412 190 A1 2/1991
GB 689542 4/1953
GB 863272 A 3/1961
WO WO 00/19450 4/2000

* cited by examiner

BETATRON WITH A REMOVABLE ACCELERATOR BLOCK

This nonprovisional application is a continuation of International Application No. PCT/EP2007/007768, which was filed on Sep. 6, 2007, and which claims priority to German Patent Application No. 10 2006 050 950.1, which was filed in Germany on Oct. 28, 2006, and which are both herein incorporated by reference.

BACKGROUND OF THE INVENTION

1. Field of the Invention

The present invention relates to a betatron with a removable accelerator block, particularly for producing x-radiation in an x-ray inspection system.

2. Description of the Background Art

X-ray inspection systems are used, as is well-known, in the inspection of large-volume articles such as containers and motor vehicles for illegal contents such as weapons, explosives, or contraband goods. In so doing, x-radiation is produced and directed at the article. The x-radiation attenuated by the article is measured by a detector and analyzed by an evaluation unit. Therefore, a conclusion can be reached on the nature of the article. This type of x-ray inspection system is known, for example, from European Pat. No. EP 0 412 190 B1, which corresponds to U.S. Pat. No. 5,065,418.

Betatrons are used to generate x-radiation with the energy of more than 1 MeV needed for the inspection. These are circular accelerators in which electrons are held in an orbit by a magnetic field. A change in this magnetic field produces an electric field, which accelerates the electrons in their orbit. A stable nominal orbit radius is determined from the so-called Wideroe condition depending on the course of the magnetic field and its change with time. The accelerated electrons are guided onto a target, where upon impacting they produce Bremsstrahlung whose spectrum depends, inter alia, on the energy of the electrons.

A betatron disclosed in German Patent Application No. DE 23 57 126 A1 includes a two-part inner yoke, in which the front sides of both inner yoke parts face each other spaced apart. A magnetic field is produced in the inner yoke by means of two main field coils. An outer yoke connects the two inner yoke part ends distant from one another and closes the magnetic circuit.

An evacuated betatron tube, in which the electrons to be accelerated circulate, is arranged between the front sides of the two inner yoke parts. The front sides of the inner yoke parts are formed in such a way that the magnetic field produced by the main field coil forces the electrons into a circular orbit and moreover focuses them onto the plane in which this orbit lies. To control the magnetic flux, it is prior in the art to arrange a ferromagnetic insert between the front sides of the inner yoke parts within the betatron tube.

Because of the produced x-radiation, betatrons are provided with lead shielding, which enables emission of the radiation only at defined places. In prior-art betatrons, for maintenance of the accelerator block, part of the lead shielding must be loosened and removed. Then, the inner part, including the accelerator block and the outer yoke, is lifted out. This has the disadvantage that in each case large masses must be moved and devices suitable for this are needed.

SUMMARY OF THE INVENTION

It is therefore an object of the present invention to provide a betatron that enables simplified maintenance and repair of the accelerator.

The core of the betatron is formed by an accelerator block with a rotationally symmetric inner yoke of two spaced-apart parts, at least one main field coil, and a torus-shaped betatron tube arranged between the inner yoke parts. The betatron further has an outer yoke, surrounding the accelerator block and connecting the two inner yoke parts, with at least one side opening and lead shielding accommodating the accelerator block and the outer yoke. In this case, the outer yoke includes at least two parts. The parts forming the outer yoke are movable relative to one another between an open and closed position and the accelerator block can be removed laterally from the opening of the outer yoke when in the open position.

The relative movement between the parts of the outer yoke is translatory, rotatory, or a combination thereof. In the case of a translatory movement, the parts of the outer yoke are shifted against one another, for example, along a guide. In the case of a rotatory movement, the parts of the outer yoke are pivoted against one another, for example, with use of a hinge joint.

If the outer yoke is in a closed position, it fixes the inner yoke in a position suitable for the operation of the betatron and closes the magnetic cycle by connecting the two inner yoke parts. In an open position of the outer yoke, the accelerator block is not fixed by the outer yoke and can be removed through its side opening.

The opposing front sides of the inner yoke parts are designed and arranged with mirror symmetry to one another. The symmetry plane in this regard is advantageously oriented so that the rotational symmetry axis of the inner yoke is perpendicular to it. This results in an advantageous field distribution in the air gap between the front sides by which the electrons in the betatron tube are kept in an orbit.

Furthermore, at least one main field coil can be arranged on the inner yoke, particularly on a neck or a shoulder of the inner yoke. This has the result that substantially the entire magnetic flux produced by the main field coil is guided through the inner yoke. In an advantageous manner, the betatron has two main field coils, a main field coil being arranged on each of the inner yoke parts. This leads to an advantageous distribution of the magnetic flux on the inner yoke parts.

In an embodiment of the invention, the betatron has a guide rail and/or a stop for the accelerator block. The guide rail enables a precise positioning of the accelerator block within the outer yoke. The stop establishes the end position of the accelerator block. In other respects, the guide rail simplifies the removal or insertion of the accelerator block, for example, in that the accelerator block rolls or glides over the guide rail.

In an embodiment, a betatron of the invention has a component for fixing the parts of the outer yoke in the closed position. These components can be, for example, screws or nuts, etc. and prevent the outer yoke from opening particularly during betatron operation. Preferably, the means for fixing the parts of the outer yoke are accessible through the lead shielding. It is possible thereby to loosen or restore the fixation without removing the lead shielding.

In an embodiment of the invention, the betatron has at least one elastic element for moving the outer yoke from the closed to the open position. The elastic element is preferably a spring, particularly a pressure spring. The use of the elastic element assures that the outer yoke assumes the open position as soon as the means for fixing the outer yoke are released. Thereby, the outer yoke is automatically kept in the open position during the removal or insertion of the accelerator block, without additional intervention by maintenance personnel being necessary. When an elastic element is used, the open position of the outer yoke can also be designated as the relaxed position and the closed position of the outer yoke as the tensioned position.

The lead shielding has a closable opening, particularly a door, for the removal of the accelerator block. In this case, the size and position of the opening is selected so that the accelerator block can be removed from the outer yoke through the opening or can be inserted in the outer yoke. Use of the opening achieves that an at least partial disassembly of the lead shielding is eliminated to access the accelerator block.

Optionally, the betatron has at least one round plate between the inner yoke parts, whereby the round plate is arranged so that its longitudinal axis coincides with the rotational symmetry axis of the inner yoke. Because of the permeability of the round plate material, the magnetic field in the region of the round plates is stronger than in the air gap, without round plates, between the front sides of the inner yoke parts. This makes it possible to influence the Wideroe condition by means of the design of the round plate(s) and thereby the orbit radius of the accelerated electrons within the betatron tube.

The betatron of the invention is advantageously used in an x-ray inspection system for security inspection of objects. Electrons are injected into the betatron and accelerated, before they are guided to a target having, for example, of tantalum. There, the electrons produce x-radiation with a known spectrum. The x-radiation is directed onto the object, preferably a container and/or a motor vehicle, and there modified, for example, by scattering or transmission attenuation. The modified x-radiation is measured by an x-ray detector and analyzed by means of an evaluation unit. A conclusion on the nature or the content of the object can be reached from the result.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
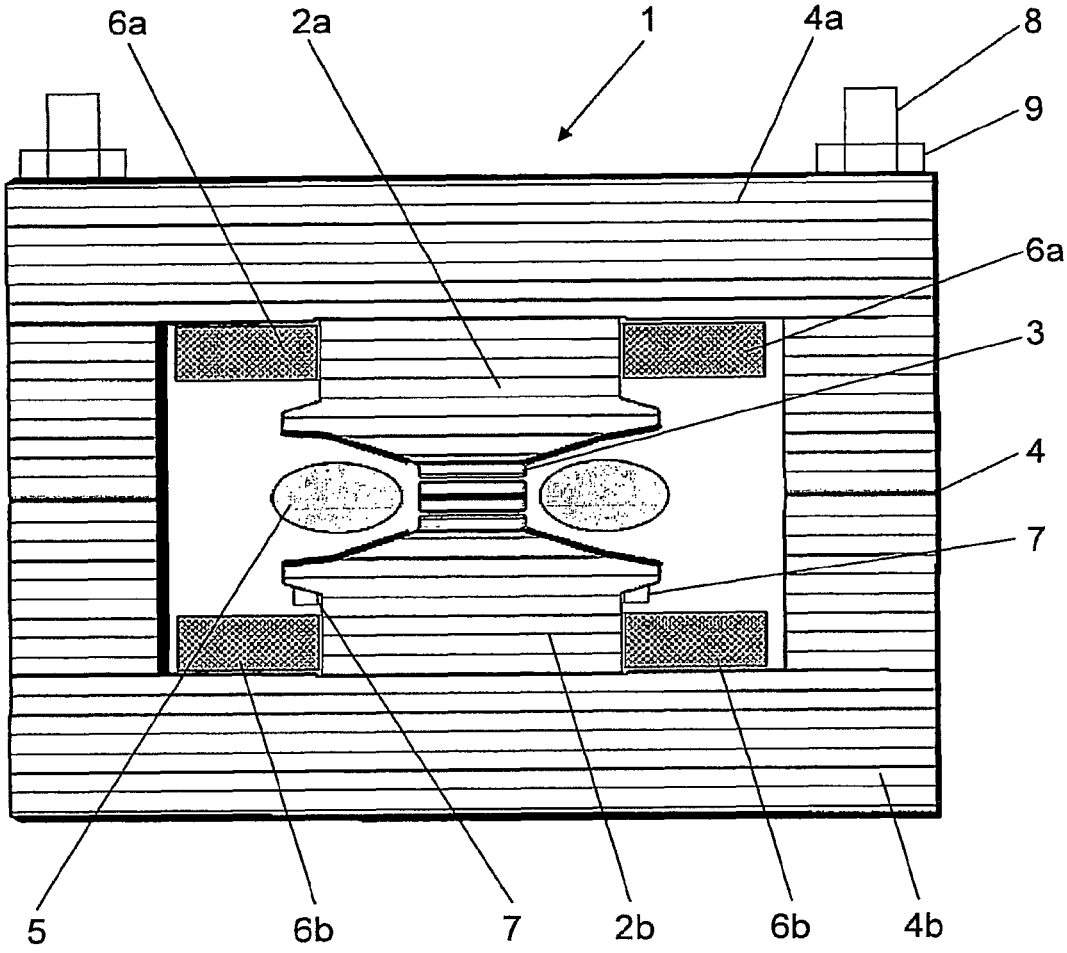
FIG. 1 shows a schematic sectional view of a betatron of the invention with the outer yoke in the closed position.

FIG. 1 shows the schematic structure of a preferred betatron 1 in cross section. The accelerator block includes a rotationally symmetric inner yoke of two spaced-apart parts 2*a*, 2*b*, a torus-shaped betatron tube 5 arranged between inner yoke parts 2*a*, 2*b*, and two main field coils 6*a* and 6*b*.

Main field coils 6*a* and 6*b* are arranged on shoulders of inner yoke parts 2*a* or 2*b*. The magnetic field produced by them penetrates inner yoke parts 2*a* and 2*b*, whereby the magnetic circuit is closed by a two-part outer yoke 4, which connects the inner yoke parts 2*a* and 2*b*. The shape of the inner and/or outer yoke can be selected by the person skilled in the art depending on the application and can deviate from the shape shown in FIG. 1. Only one or more than two main field coils may also be present.

Betatron 1 furthermore has optional round plates 3 between inner yoke parts 2*a*, 2*b*, whereby the longitudinal axis of round plates 3 corresponds to the rotational symmetry axis of the inner yoke. The magnetic field between the front sides of the inner yoke parts and thereby the Wideroe condition can be influenced by the design of round plates 3. The number and/or shape of the round plates are left to the implementing person skilled in the art.

Between the front sides of inner yoke parts 2*a* and 2*b*, the magnetic field runs partially through round plates 3 and otherwise through an air gap. Betatron tube 5 is arranged in said air gap. This is an evacuated tube in which the electrons are accelerated. The front sides of inner yoke parts 2*a* and 2*b* have a shape that is selected so that the magnetic field between them focuses the electrons in an orbit. The design of the front sides is known to the person skilled in the art and is therefore not explained in greater detail. At the end of the acceleration process, the electrons hit a target and thereby produce x-radiation whose spectrum depends, inter alia, on the final energy of the electrons and the material of the target.

For acceleration, the electrons are injected with an initial energy into betatron tube 5. During the acceleration phase, the magnetic field in betatron 1 is continuously increased by main field coils 6*a* and 6*b*. As a result, an electric field is produced that exerts an accelerating force on the electrons. At the same time, due to the Lorentz force, the electrons are forced into a nominal orbit within betatron tube 5.

The acceleration of the electrons is repeated periodically, which results in a pulsed x-radiation. In each period, in a first step the electrons are injected into betatron tube 5. In a second step, the electrons are accelerated by an increasing current in main field coils 6*a* and 6*b* and thereby an increasing magnetic field in the air gap between inner yoke parts 2*a* and 2*b* in the circumferential direction of its orbit. In a third step, the accelerated electrons are deflected onto the target to produce x-radiation. Then an optional pause follows before electrons are again injected into betatron tube 5.

Figure 2:
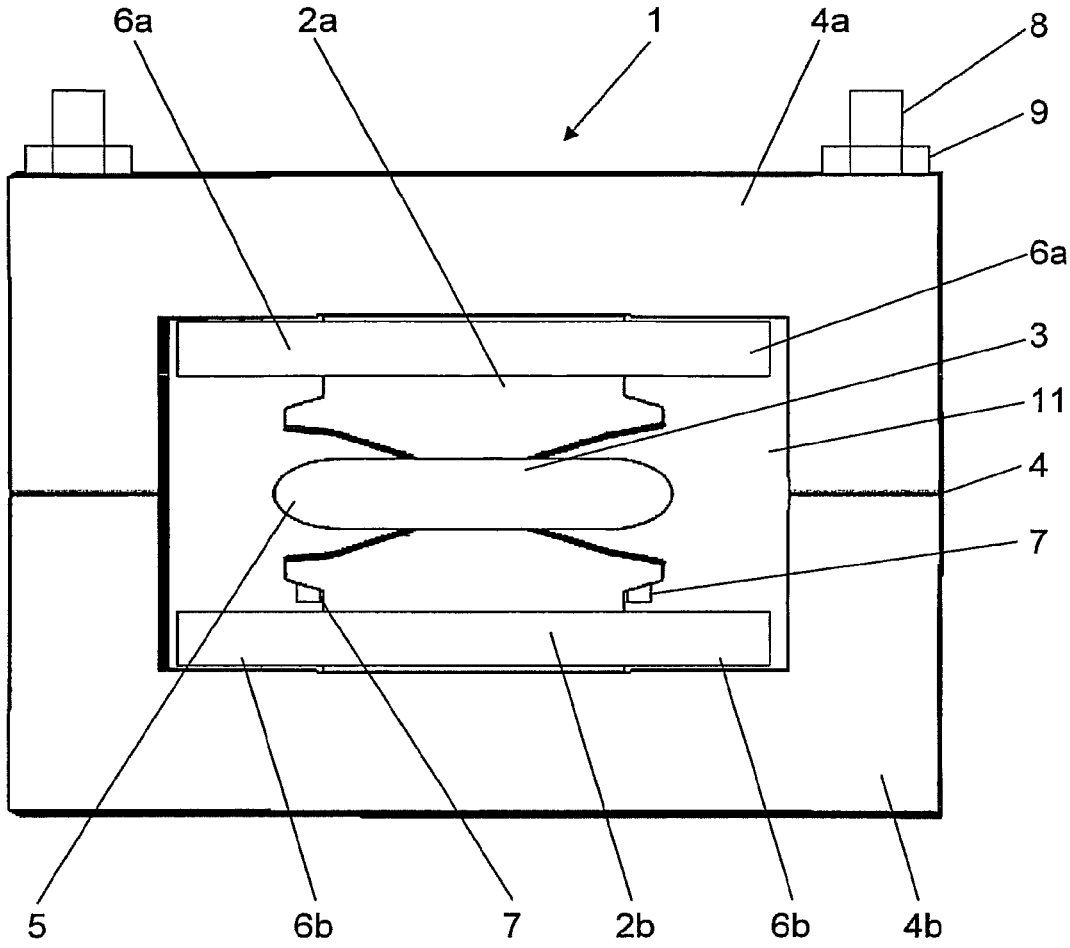
FIG. 2 shows a schematic side view of the betatron of the invention of FIG. 1 with the outer yoke in the closed position.

FIG. 2 shows the side view of the betatron of FIG. 1. Outer yoke 4 has a side opening 11, which in the visible directions has at least the size of the accelerator block. In the closed state of outer yoke 4, which is shown in FIGS. 1 and 2, the accelerator block is clamped in outer yoke 4 and held in its position.

Outer yoke 4 includes the two parts 4*a* and 4*b*, which can be moved in a translatory manner against one another. Outer yoke 4*a* is guided by threaded bolts 8, which run through recesses in outer yoke part 4*a* and are connected to outer yoke part 4*b*. Nuts 9 on threaded bolts 8 serve to fix outer yoke part 4*a* in the closed position of outer yoke 4 as shown in FIGS. 1 and 2.

Figure 3:
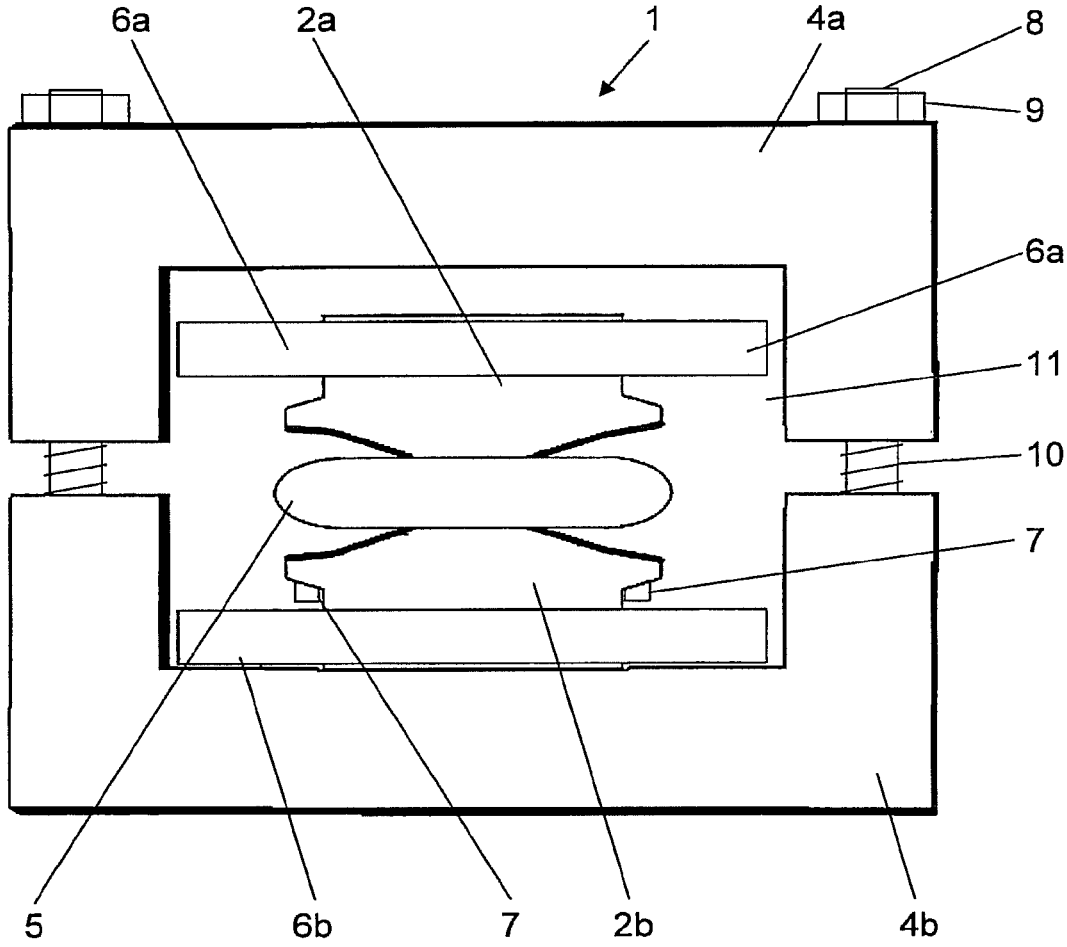
FIG. 3 shows a schematic side view of the betatron of the invention of FIG. 1 with the outer yoke in the open position.

In the side view of betatron 1 as shown in FIG. 3, nuts 9 are loosened and outer yoke 4 is in an open position. Pressure springs 10 push apart outer yoke parts 4*a* and 4*b*, so that a gap forms between them. For clarification, this gap is shown larger in FIG. 3 than would be necessary to carry out the function of the invention in practice. In this relaxed state of outer yoke 4, the accelerator block of betatron 1 can be removed simply through side opening 11 in outer yoke 4 from said yoke or inserted into it. Guide rails 7, on the one hand, support the weight of the accelerator block during removal or insertion and, on the other, provide for a precise positioning of the accelerator block within outer yoke 4.

For maintenance on the accelerator block, therefore, first the outer yoke 4 is relaxed by opening nuts 9 and the accelerator block removed through side opening 11 from inner yoke 4. After maintenance or repair of the accelerator block, it is again inserted in inner yoke 4 and it is again tensioned by tightening of nuts 9. In this case, nuts 9 are accessible with a tool through the lead shielding, which envelops betatron 1 and is not shown in the figures. The lead shielding furthermore has a door, which covers side opening 11 of outer yoke 4 and is dimensioned so that the accelerator block can be removed through it from outer yoke 4 or inserted in outer yoke 4.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A betatron for an x-ray inspection system with an accelerator block comprising:

a rotationally symmetric inner yoke of two spaced-apart parts;

at least one main field coil;

a torus-shaped betatron tube arranged between the inner yoke parts; and an outer yoke surrounding the accelerator block and connecting the two inner yoke parts with at least one side opening and lead shielding accommodating the accelerator block and the outer yoke, the outer yoke including at least two parts, the two parts forming the outer yoke being configured to be movable relative to one another between an open and closed position, and the accelerator block being configured to be removed laterally out of the opening of the outer yoke in the open position.

2. The betatron according to claim 1, wherein the opposing front sides of the inner yoke parts are designed and arranged with mirror symmetry to one another.

3. The betatron according to claim 1, wherein at least one main field coil is arranged on the inner yoke, particularly on a neck or a shoulder of the inner yoke.

4. The betatron according to claim 3, further comprising two main field coils, wherein a main field coil is arranged on each of the inner yoke parts.

5. The betatron according claim 1, further comprising a guide rail and/or a stop for the accelerator block.

6. The betatron according to any one of claim 1, further comprising at least one elastic element for moving the outer yoke from the closed to the open position.

7. The betatron according to claim 6, wherein the elastic element is a spring or a pressure spring.

8. The betatron according to claim 1, further comprising a component for fixing the parts of the outer yoke in the closed position.

9. The betatron according to claim 8, wherein the component for fixing the parts of the outer yoke are accessible through the lead shielding.

10. The betatron according to claim 8, wherein the component for fixing the parts of the outer yoke are screws or nuts.

11. The betatron according to claim 1, further comprising a closable opening, particularly a door, in the lead shielding for removing the accelerator block.

12. An x-ray inspection system for security inspection of objects, comprising:

a target to produce x-radiation;

an x-ray detector;

an evaluation unit; and a betatron comprising:

a rotationally symmetric inner yoke of two spaced-apart parts;

at least one main field coil;

a torus-shaped betatron tube arranged between the inner yoke parts; and an outer yoke surrounding the accelerator block and connecting the two inner yoke parts with at least one side opening and lead shielding accommodating the accelerator block and the outer yoke, the outer yoke including at least two parts, the two parts forming the outer yoke being configured to be movable relative to one another between an open and closed position, and the accelerator block being configured to be removed laterally out of the opening of the outer yoke in the open position.

* * * * *